United States Patent [19]

Okoshi et al.

[11] Patent Number: 5,009,077

[45] Date of Patent: Apr. 23, 1991

[54] MULTI-SYSTEM AIR CONDITIONER

[75] Inventors: Seiji Okoshi; Eiji Kuwahara, both of Fuji, Japan

[73] Assignee: Kabushiki Kaisha Toshiba, Kawasaki, Japan

[21] Appl. No.: 558,152

[22] Filed: Jul. 26, 1990

[30] Foreign Application Priority Data

Jul. 28, 1989 [JP] Japan ..... 1-195684

[51] Int. Cl.[5] ..... F25B 13/00

[52] U.S. Cl. ..... 62/160; 62/174; 62/324.4

[58] Field of Search ..... 237/2 B; 62/160, 324.4 X, 62/324.6, 324.1, 174 X

[56] References Cited

U.S. PATENT DOCUMENTS 4,528,822 7/1985 Glamm ..... 62/324.4 X 4,878,357 11/1989 Sekigami et al. ..... 62/160

FOREIGN PATENT DOCUMENTS 61-45145 10/1986 Japan .

*Primary Examiner*—William E. Wayner

*Attorney, Agent, or Firm*—Cushman, Darby & Cushman

[57] ABSTRACT

The air conditioner is disclosed which determines a stop mode of an outdoor heat exchanger when a difference between a total of a heating power level or levels requested from one or more indoor units and a total of a cooling power level or levels requested from one or more remaining indoor units falls within a predetermined range and, when the stop mode of the outdoor heat exchanger is set, forcedly recovers a regrigerant which is accumulated on the outdoor heat exchanger back to a compressor.

9 Claims, 12 Drawing Sheets

MULTI-SYSTEM AIR CONDITIONER

BACKGROUND OF THE INVENTION

1. Field of the Invention

The present invention relates to a multi-system air conditioner including a plurality of indoor units.

2. Description of the Related Art

Known in the art is a multi-system air conditioner which includes one outdoor unit and a plurality of indoor units and provides a heat pump type refrigerating apparatus among the units.

The multi-system air conditioner of this type can heat or cool a plurality of rooms in a house or a building at a time and is convenient in this sense.

In those buildings, however, some having a computer room, some having a perimeter zone and some having an interior zone, a cooling request comes from a given location or locations and, at the same time, a heating request comes from other locations.

In this case, it is not possible to operate the air-conditioner such that one of the heating and cooling requests is given a priority over the other.

There is a possibility that a better environment will be created at some location but that the workers in other locations will feel uncomfortable or apparatuses, such as computers, in still other locations will sometimes fail.

Such an unfavorable condition or conditions are liable to occur in the buildings or the common houses especially in an intervening season between the spring and the autumn.

An air conditioner as will be set out below has recently emerged which can operate at least one of indoor units in a cooling operation mode and one or more remaining indoor units in a heating operation mode. This type of air conditioner is shown, for example, in Published Examined Japanese Patent Application 61-45145.

When a cooling load is greater than a heating load in the air conditioners of this type, a heat exchanger in the indoor unit of a cooling operation mode serves as an evaporator and a heat exchanger in the indoor unit of the heating operation mode, as well as the outdoor heat exchanger, serves as a condenser.

When, on the other hand, the heating load is greater than the cooling load, the heat exchanger in the indoor units of the heating operation mode acts as a condenser and the heat exchanger in the indoor units of the cooling operation mode, as well as the outdoor heat exchanger, acts as an evaporator.

When the cooling load is substantially the same as the heating load, a stream of a refrigerant into the outdoor heat exchanger is stopped, allowing the heat exchanger in the indoor units of the heating operation mode to function as a condenser and the indoor unit of the cooling operation mode to function as an evaporator.

The use of such a type of air conditioner can eliminate a drawback as set forth above.

In the operation mode where the cooling load is substantially equal to the heating load, a refrigerant may sometimes be accumulated on the outdoor heat exchanger.

A short supply of a refrigerant through the respective indoor units may occur, causing a decline in a cooling or a heating capacity of their own.

SUMMARY OF THE INVENTION

It is accordingly the object of the present invention to provide a multi-system air conditioner which, upon being operated under substantially equal heating and cooling loads, can eliminate a possible short supply of refrigerant through indoor units and ensure adequate heating and cooling power levels of their own.

In order to achieve the aforementioned object, there is provided a multi-system air conditioner comprising:

an outdoor unit including a compressor for sucking, compressing and delivering a refrigerant and an outdoor heat exchanger for making an exchange between heat in an incoming refrigerant and heat in outerdoor air;

a plurality of indoor units including an indoor heat exchanger, each, for allowing an exchange between the heat in the incoming refrigerant and the heat in the indoor air and requesting at least one of a cooling operation mode and cooling power level and a heating operation mode and heating power level;

means for determining a cooling operation mode when a total of a cooling power level or levels requested from one or more indoor units is greater than a total of a heating power level or levels requested from one or more remaining indoor units;

means for enabling a refrigerant which is delivered from the compressor to pass through the outdoor heat exchanger, when a cooling operation mode is determined, and to be returned back to the compressor via one or more indoor units calling for a cooling operation mode;

means for enabling one stream of the refrigerant which is delivered from the compressor to pass through one or more indoor units calling for a heating operation mode and to meet a refrigerant flowing into one or more outdoor units calling for a cooling operation mode;

means for determining a heating operation mode when a total of a heating power level or levels requested from one or more indoor units is greater then a cooling power level or levels requested from one or more remaining indoor units;

means for enabling the refrigerant which is delivered from the compressor to pass through one or more indoor units calling for a heating operation mode, when the heating operation mode is determined, and to be returned back to the compressor via the outdoor heat exchanger;

means for enabling one stream of a refrigerant which passes through one or more indoor units calling for a heating operation mode to circulate through one or more indoor units calling for a cooling operation mode, when a heating operation mode is determined, and to be returned back to the compressor;

first detecting means for detecting a temperature in the outdoor heat exchanger;

means for determining a stop mode of the outdoor heat exchanger when a difference between a total of a heating power level or levels requested from one or more indoor units and that of a cooling power level or levels requested from one or more remaining indoor units falls within a predetermined range;

means for enabling a refrigerant which is delivered from the compressor to pass through one or more indoor units calling for a heating operation mode, when the stop mode of the outdoor heat exchanger is determined, and to be returned back to the compressor via one or more indoor units calling for a cooling operation mode;

second detecting means for detecting a saturation temperature prevalent in the refrigerant flowing through the indoor unit, when the stop mode of the outdoor heat exchanger is determined; and recovering means which, when the stop mode of the outdoor heat exchanger is determined, enables a refrigerant which is accumulated on the outdoor heat exchanger to be recovered back to the compressor if a result of detection by the second detecting means is higher than a result of detection by the first detecting means.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

A first embodiment of the present invention will be explained below with reference to the accompanying drawings.

Figure 1:
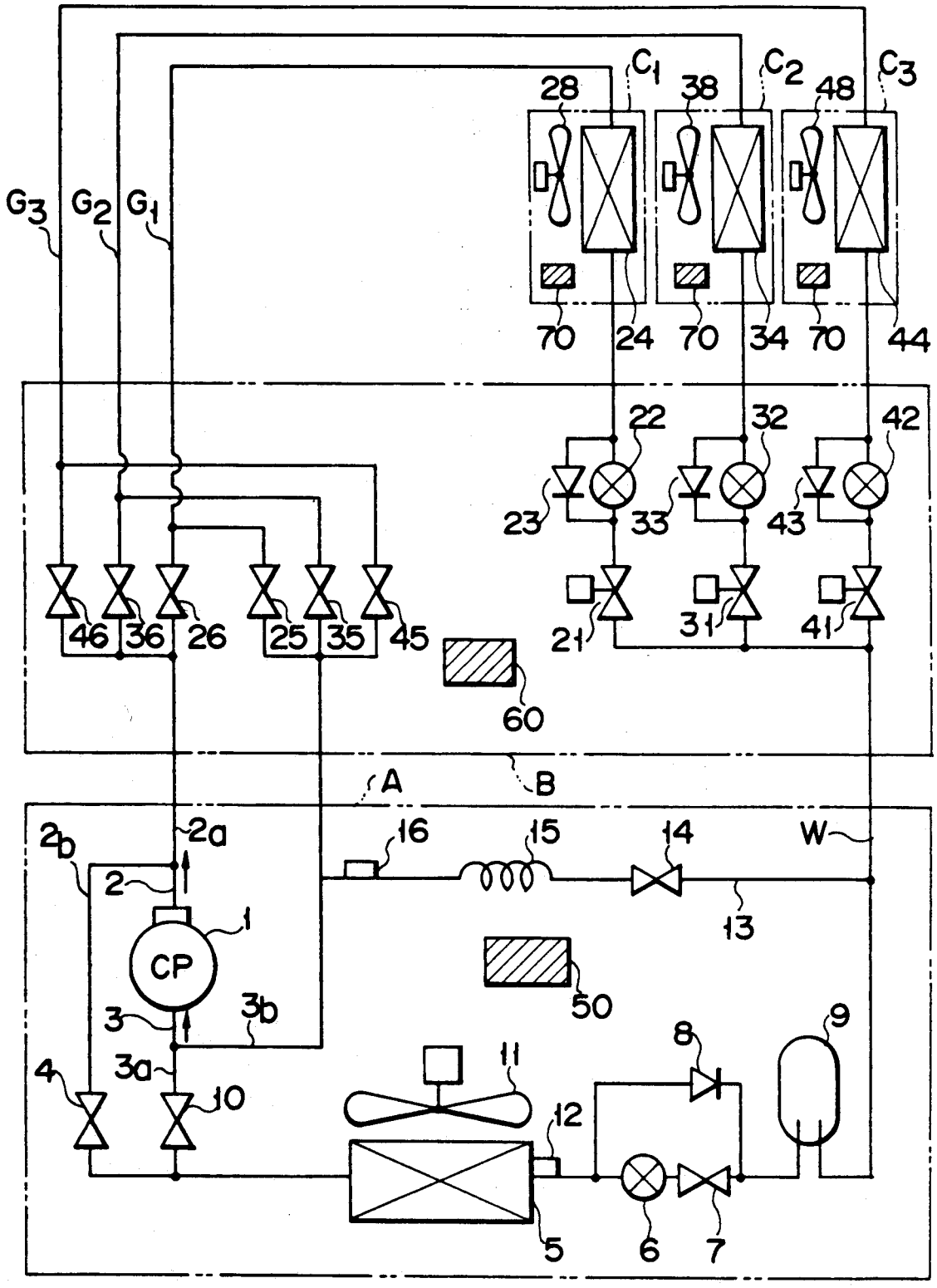
FIG. 1 is a view showing a refrigeranting apparatus in a first embodiment of the present invention.

In FIG. 1, A denotes an outdoor unit which is connected by a branch unit B to indoor units $C_1$, $C_2$ and $C_3$.

The outdoor unit A, branch unit B and indoor units $C_1$, $C_2$, and $C_3$ constitute a refrigeranting apparatus as will be set out below.

The outdoor unit A includes a capacity-variable compressor 1 which sucks a refrigerant via a suction inlet and, after being compressed, delivers it via an delivery outlet.

An delivery tube 2 is connected to the delivery outlet of the compressor 1.

A suction tube 3 is connected to the suction inlet of the compressor 1.

The delivery tube 2 is branched into two delivery tubes **2*a* and 2*b***.

The suction tube 3 is branched into two suction tube **3*a* and 3*b***.

An outdoor heat exchanger 5 is connected via an electromagnetic type two-way valve 4 to the delivery tube **2*a*** and allows an exchange between heat in an incoming refrigerant and heat in outdoor air.

A liquid tank 9 is connected to the outdoor heat exchanger 5 through a check valve 8 in one route and through a series circuit, in another route, of an expansion valve 6 and electromagnetic type two-way valve 7. The liquid tank 9 is connected to a liquid-side tube W.

Through the electromagnetic two-way valve 10, the suction tube **3*a* is connected to a tube extending between the two-way valve 4 and the outdoor heat exchanger 5**.

Expansion valves 22, 32 and 42 are connected to the liquid-side tube W, respectively through pulse motor valves (hereinafter referred to as PMV's) 21, 31 and 41 in the branch unit B.

Check valves 23, 33 and 43 are connected to the expansion valves 22, 32 and 42, respectively, in its own parallel way.

Indoor heat exchangers 24, 34 and 44 of the indoor units $C_1$, $C_2$ and $C_3$ are connected to the expansion valves 22, 32 and 42, respectively, and allow an exchange between heat in an incoming refrigerant and heat in indoor air.

Gas-side tubes $G_1$, $G_2$ and $G_3$ are connected to the indoor heat exchangers 24, 34 and 44.

The gas-side tubes $G_1$, $G_2$ and $G_3$ are each branched into two tube.

One route of each of the gas-side tubes $G_1$, $G_2$ and $G_3$ is connected to the suction tube **3*b* through a corresponding one of electromagnetic two-way valves 25, 35 and 45** in the branch unit B.

The other route of each of the gas-side tube $G_1$, $G_2$ and $G_3$ is connected to the delivery tube **2*a* of the compressor 1 through a corresponding one of electro-magnetic type two-way valves 26, 36 and 46** in the branch unit B.

In the outdoor unit A, an outdoor fan 11 is provided to circulate outdoor air through the outdoor heat exchanger 5.

A temperature sensor 12 is provided, as a first detecting means, in the outdoor heat exchanger 5.

The temperature sensor 12 detects a temperature in the outdoor heat exchanger 5.

A bypass tube 13 is connected at one end to the liquid-side tube W and at the other end to the suction tube **3*b* of the compressor 1 through an electromagnetic two-way tube 14 and capillary tube 15 in which case a temperature sensor 16 is provided in the bypass tube 13 at a location downstream of the capillary tube 15**.

The bypass tube 13, two-way valve 14, capillary tube 15 and temperature sensor 16 constitute a second detecting means.

Indoor fans 28, 38 and 48 are provided in the indoor units $C_1$, $C_2$ and $C_3$, respectively, at their own heat exchangers 24, 34 and 44 to circulate air in the respective heat exchanger.

An outdoor control section 50 is provided in the outdoor unit A.

The outdoor control section 50 controls an inverter circuit for compressor drive, two-way valves 4, 7, 10 and 14, and outdoor fan 11.

The branch unit B includes a multi-control section 60.

The multi-control section 60 controls the RMV's 21, 31 and 41, valve control valves 25, 35 and 45, and two-way valves 26, 36 and 46.

The indoor units $C_1$, $C_2$ and $C_3$, each, include an indoor control unit 70.

The indoor control sections 70 transmit at least one of a cooling operation mode and cooling power level requested and a heating operation mode and heating power level requested and control indoor fans 28, 38 and 48.

The following functions are performed by the outdoor control section 50, multi-control section 60, respective RMV's and respective two-way valves.

(1) A means is provided for determining a cooling operation mode when a total of a cooling power level or levels requested from one or more indoor units is greater than a total of a heating power level or levels requested from one or more remaining indoor units.

(2) A means is provided for allowing a refrigerant which is delivered from the compressor 1 to pass through the outdoor heat exchanger 5, when a cooling operation mode is determined, and to be returned back to the compressor 1 through one or more indoor units calling for the cooling operation mode.

(3) A means is provided for allowing one stream of a refrigerant which is delivered from the compressor 1 to circulate through one or more indoor units calling for the heating operation mode, when a cooling operation mode is determined, and to enter the refrigerant stream flowing into one or more indoor units calling for the cooling operation mode.

(4) A means is provided for determining a heating operation mode when a total of a heating power level or levels requested from one or more indoor units is greater than a total of a cooling power level or levels requested from one or more remaining indoor units.

(5) A means is provided for allowing a refrigerant which is delivered from the compressor 1 to circulate through one or more indoor units calling for a heating operation mode, when a heating operation mode is determined, and to be returned back to the compressor 1 via the outdoor heat exchanger 5.

(6) A means is provided for allowing one stream of a refrigerant which passes through one or more indoor units calling for a heating operation mode to circulate through one or more indoor units calling for a cooling operation mode, when a heating operation mode is determined, and to be returned back to the compressor 1.

(7) A means is provided for determining a stop mode of the outdoor heat exchanger 5 when a difference between a total of a heating power level or levels requested from one or more indoor units and a total of a cooling power level or levels requested from one or more remaining indoor units falls within a given range.

(8) A means is provided for allowing a refrigerant which is delivered from the compressor 1 to circulate through one or more indoor units calling for a heating operation mode, when a stop mode of the outdoor heat exchanger 5 is determined, and to be returned back to the compressor 1 through one or more indoor calling for a cooling operation mode.

(9) A second detecting means is provided for detecting a saturation temperature prevalent in a refrigerant flowing in the respective indoor unit, when a stop mode of the outdoor heat exchanger 5 is determined.

(10) A means is provided which, when the stop mode of the outdoor heat exchanger 5 is determined, allows a refrigerant which is accumulated in the outdoor heat exchanger 5 to be recovered into the compressor 1 if a result of detection by the second detection means is higher than a result of detection by the first detection means (temperature sensor 12).

Figure 2:
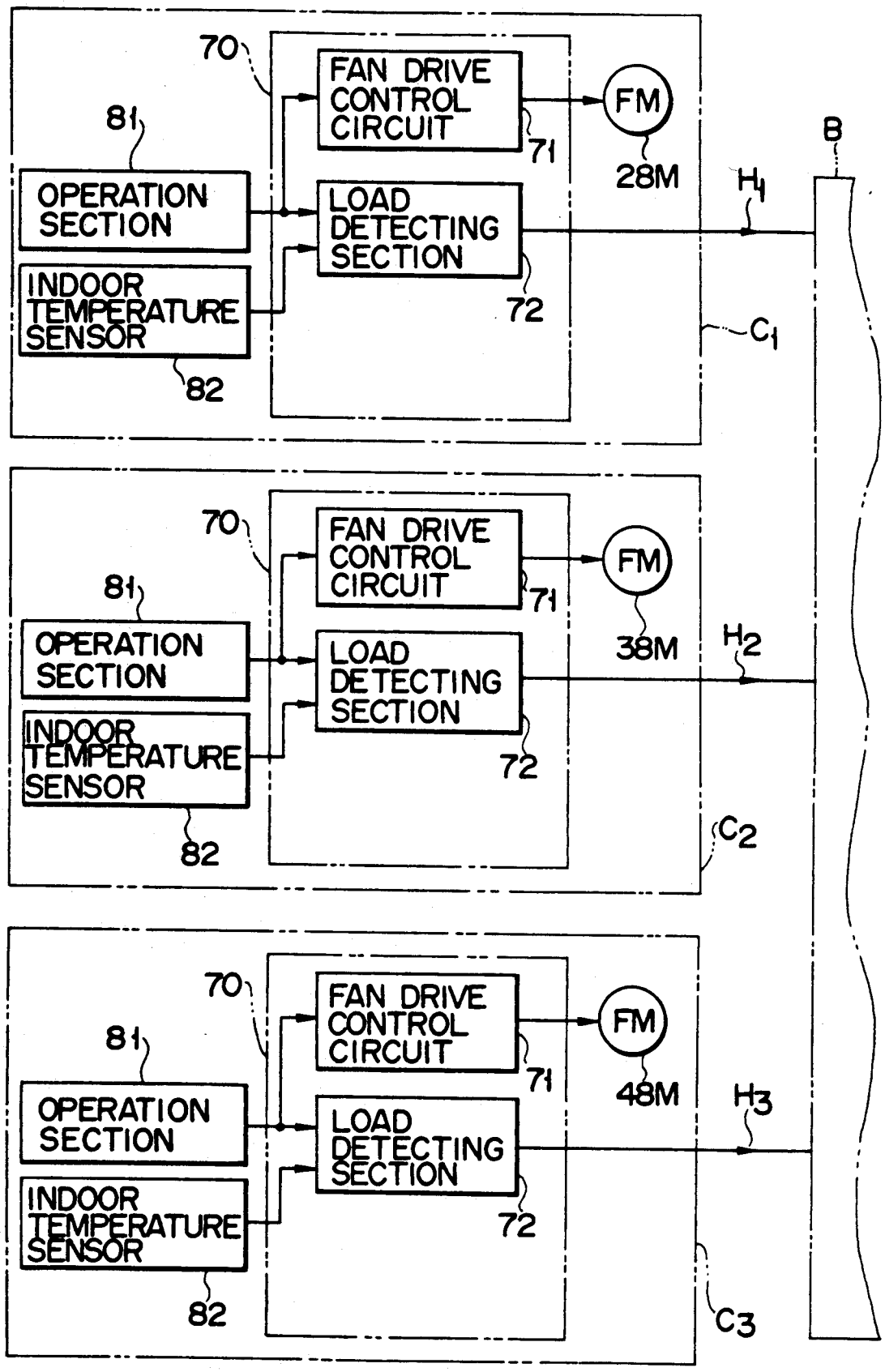
FIG. 2 is a block diagram showing an indoor control section and its peripheral circuits in the aforementioned embodiment.

FIG. 2 shows the indoor control section 70 and its associated circuits.

The respective indoor control section 70 comprises a fan drive control circuit 71 and load detecting section 72.

The fan drive control circuit 71 in the indoor unit $C_1$ controls a motor 28M for the indoor fan 28 by operating the operation section 81.

The fan drive control circuit 71 in the indoor unit $C_2$ controls a motor 38M for the indoor fan 38 by operating the operation section 81.

The fan drive control circuit 71 in the indoor unit $C_3$ controls a motor 48 for the indoor fan 48 by operating the operating section 81.

A load detecting section 72 in the indoor unit $C_1$ performs the following functions.

(1) An operation mode request made by the operation section 81 is sent, as a signal $H_1$, to the multicontrol section 60.

(2) A difference between an indoor temperature set by the operation of the operation section 81 and the detection temperature of the indoor temperature sensor 82 is detected as a load.

(3) A requested cooling power level or heating power level corresponding to the detected load is sent as the signal $H_1$ to the multi-control section 60.

The load detecting section 72 in the indoor unit $C_2$ has the following functions.

(1) An operation mode request made by the operation of the operation section 81 is sent, as a signal $H_2$, to the multi-control section 60.

(2) A difference between an outdoor temperature set by the operation section 81 and the detection temperature of the indoor temperature sensor 82 is detected as a load.

(3) A requested cooling power level or heating power level corresponding to the detected load is sent, as the signal $H_2$, to the multi-control section 60.

The load detecting section 72 in the indoor unit $C_3$ performs the following functions.

(1) An operation mode request made by setting the operation section 81 is sent, as a signal $H_2$, to the multi-control section 60.

(2) A difference between an indoor temperature set by the operation section 81 and the detection temperature of the indoor temperature sensor 82 is detected as a load.

(3) A requested cooling power level or heating power level corresponding to the detected load is sent, as the signal $H_3$, to the multi-control section 60.

Figure 3:
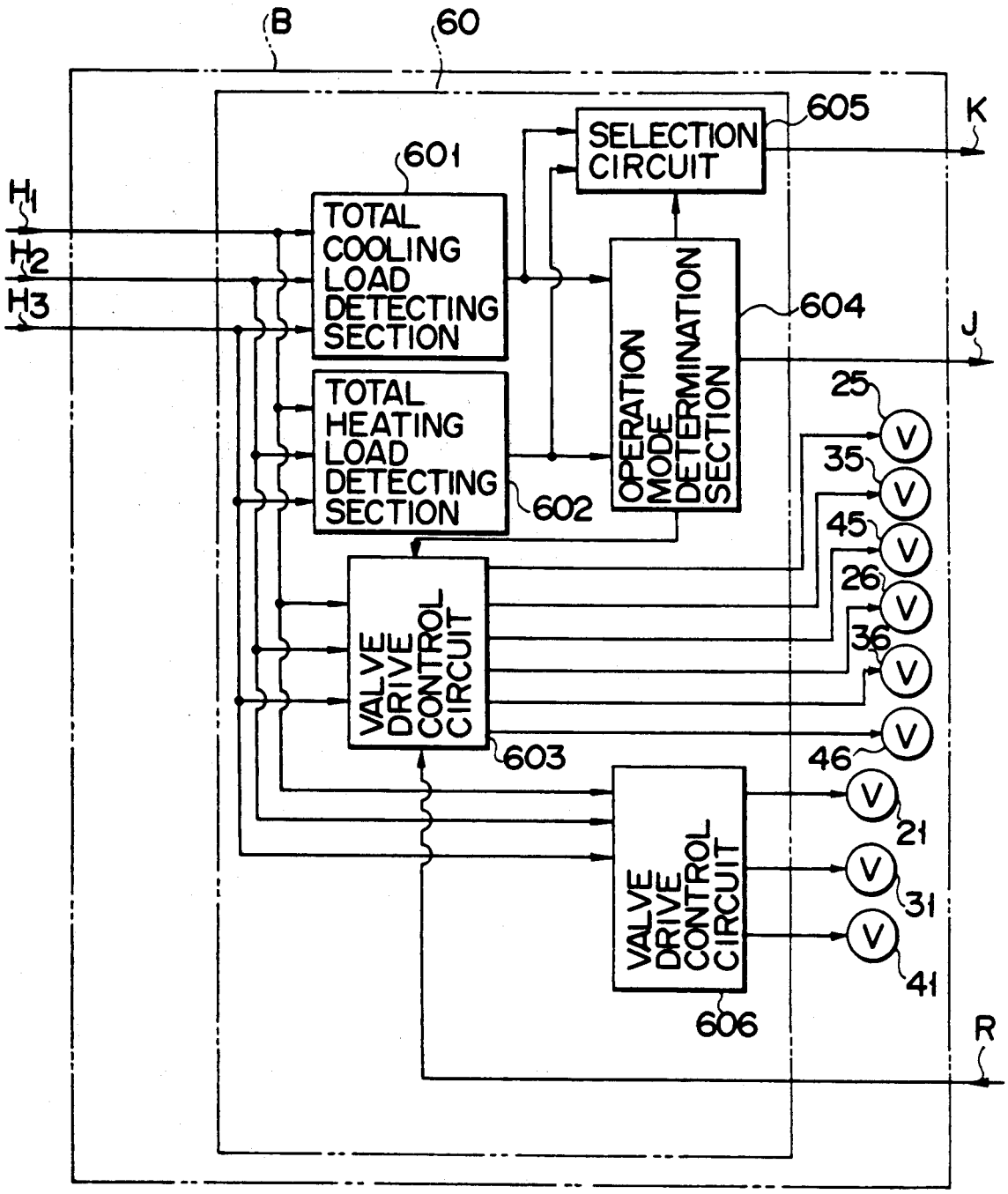
FIG. 3 is a block diagram showing a multi-control section and its peripheral circuits in the aforementioned embodiment.

The multi-control section 60 and its associated circuits are shown in FIG. 3.

The multi-control circuit 60 comprises a total cooling load detecting section 601, total heating load detecting section 602, valve drive control circuit 603, operation mode determination section 604, selection circuit 605 and valve drive control circuit 606.

The total cooling load detecting section 601 performs the following functions.

(1) A requested cooling level is determined by the signals $H_1$, $H_2$ and $H_3$ of the respective indoor control sections 70.

(2) The total cooling power level thus determined is detected.

The total heating load detecting section 602 has the following functions.

(1) A requested heating power level is determined by the signals $H_1$, $H_2$ and $H_3$ of the respective indoor control sections 70.

(2) A determined total heating power level is detected.

The valve drive control circuit 603 has the following functions.

(1) The cooling and heating operation modes are determined by the signals $H_1$, $H_2$ and $H_3$ of the respective indoor control sections 70.

(2) The opening and closing of the two-way valves 25, 35, 45, 26, 36 and 46 are controlled in accordance with a result of determination. For example, the two-way values 25 and 26 are opened and closed, respectively, when a cooling operation mode is requested by a signal $H_1$, and the two-way valves 25 and 26 are closed and opened when a heating operation mode is requested by a signal $H_1$.

(3) When the operation mode determination section 604 determines a stop mode of the outdoor heat exchanger 5, the two-way valves 25, 35 and 45 are forcedly closed if a recovery instruction signal R is received from the outdoor control section 50.

The operation mode determination section 604 performs the following functions.

(1) A cooling operation mode is determined when a total cooling power level detected by the total cooling load determining section 601 is greater than a total heating power level detected by the total heating load detecting section 602.

(2) A heating operation mode is determined when a total heating power level detected by the total heating load detecting section 602 is greater than a total cooling power level detected by the total cooling load detecting section 601.

(3) A stop mode of the outdoor heat exchanger 5 is determined when a difference between a total heating power level detected by the total heating load detecting section 602 and a total cooling power level detected by the total cooling load detecting section 601 falls within a given range.

(4) The contents of the determinations as set out above are each sent, as a signal J, to the outdoor control section 50.

The section circuit 605 performs various functions as set out below.

(1) When a cooling operation mode is determined by the operation mode determination section 604, a total cooling power level detected by the total cooling load detecting section 604 is sent, as a signal K, to the outdoor control section 50.

(2) When a heating operation mode is determined by the operation mode determination section 604, a total heating power level detected by the total heating load determining section 602 is sent, as a signal K, to the outdoor control section 50.

(3) When a stop mode of the outdoor heat exchanger 5 is determined by the operation mode determination section 604, a total heating power level detected by the total heating load detecting section 602 is sent, as a signal K, to the outdoor control section 50 as in the case of the heating operation mode.

The valve drive control circuit 606 controls the RMV's 21, 31 and 41 and performs the following functions.

(1) The requested cooling and heating operation modes are determined by signals $H_1$, $H_2$ and $H_3$ of the respective indoor control sections 70.

(2) When a cooling operation mode is requested by the signal $H_1$, the extent opening of the PMV 21 corresponding to the indoor unit $C_1$ is controlled in accordance with a cooling power level requested by the signal $H_1$. When a cooling operation mode is requested by a signal $H_2$, the extent of opening of the PMV 31 corresponding to the indoor unit $C_2$ is controlled in accordance with a cooling power level requested by the signal $H_2$. When a cooling operation mode is requested by the signal $H_3$, the extent of opening of the PMV 41 corresponding to the indoor unit $C_3$ is controlled in accordance with a cooling power level requested by the signal $H_3$.

(3) When a heating operation mode is requested by a signal $H_1$, the extent of opening of the PMV 21 corresponding to the indoor unit $C_1$ is controlled in accordance with a heating power level requested by the signal $H_1$. When a heating operation mode is requested by a signal $H_2$, the extent of opening of the PMV 31 corresponding to the indoor unit $C_2$ is controlled in accordance with a heating power level requested by the signal $H_2$. When a heating operation mode is requested by a signal $H_3$, the extent of opening of the PMV 41 corresponding to the indoor unit $C_3$ is controlled in accordance with a heating power level requested by the signal $H_3$.

Figure 4:
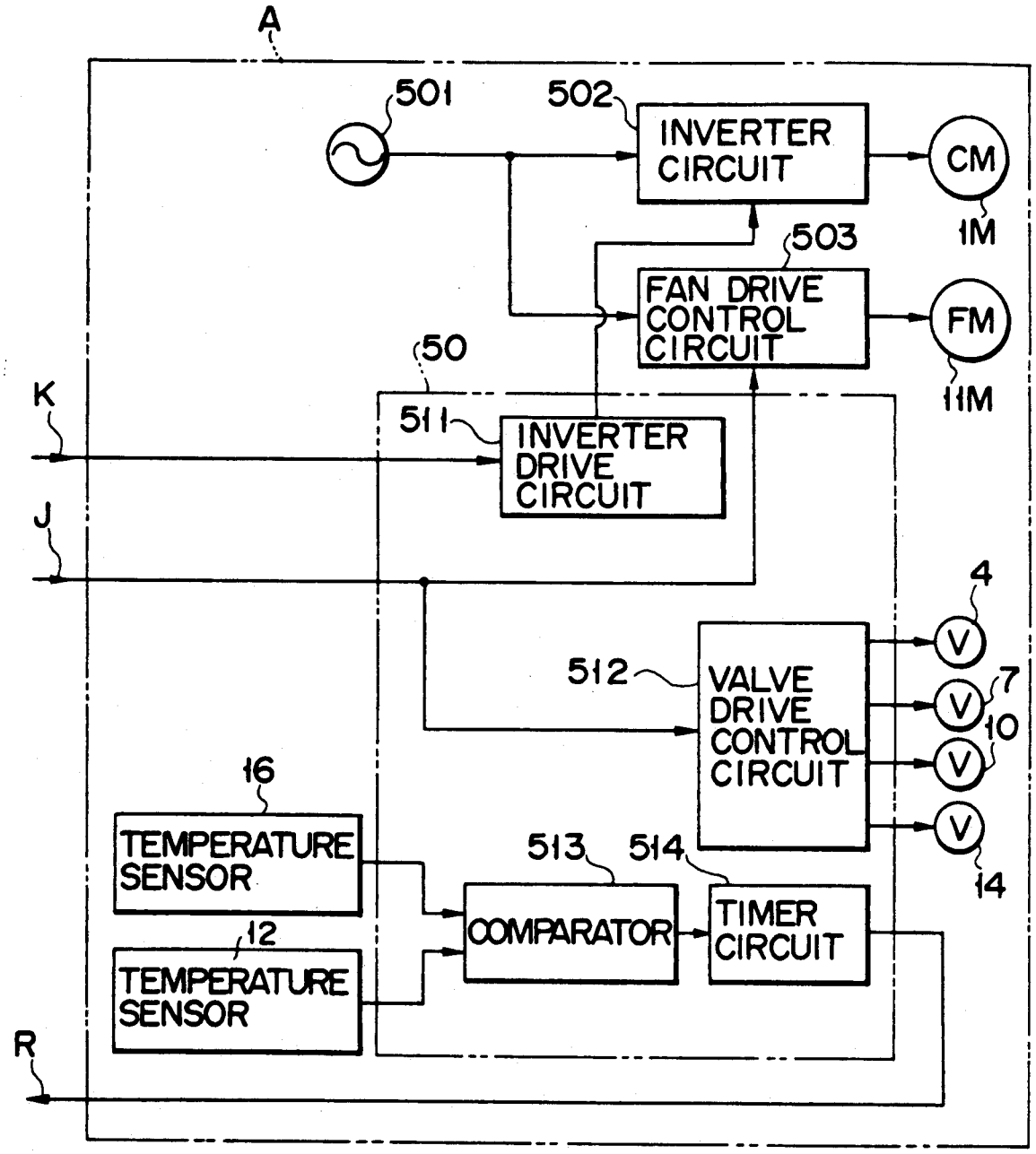
FIG. 4 is a block diagram showing an outdoor control section and its peripheral circuits in the aforementioned embodiment.

FIG. 4 shows the outdoor control section 50 and its associated circuits.

In FIG. 4, reference numeral 501 shows a commercial AC supply which is connected to an inverter circuit 502 and a fan drive control circuit 503.

The inverter circuit 502 rectifies a voltage waveform of the AC supply 501 and, after converting a rectified wave to an AC voltage of a predetermined frequency, delivers the AC voltage, as a drive power, to motor 1M in the compressor 1.

When the operation mode is determined by the operation mode determination section 604, the fan drive control circuit 503 delivers a power supply voltage (power supply 501) upon receipt of a signal J. The output voltage of the fan drive control circuit 503 is supplied, as a drive power, to a motor 11M for the outdoor fan 11.

The outdoor control section 50 comprises an inverter drive circuit 511, valve drive control circuit 512, comparator 513 and timer circuit 514.

The inverter drive circuit 511 performs the following functions.

(1) A total of cooling power levels or heating power levels requested from the respective indoor units is determined based on a signal K of the multi-control section 60.

(2) The output frequency of the inverter circuit 502 is controlled in accordance with the total level determined.

The valve drive control circuit 512 performs functions as given below.

(1) When a signal J of the multi-control section 60 represents that a cooling operation mode is determined, the two-way valve 4 is opened and the two-way valves 7, 10 and 14 are closed.

(2) When a signal J of the multi-control section 60 represents that a heating operation mode is determined, the two-way valves 4 and 14 are closed and the two-way valves 7 and 10 are opened.

(3) When a signal J of the multi-control section 60 represents that a stop mode of the indoor heat exchanger 5 is determined, the two-way valves 4 and 7 are closed and the two-way valves 10 and 14 are opened.

The comparator 513 compares the detection temperature of a temperature sensor 16 with that of a temperature sensor 12 and delivers a logic "1" signal when the detection temperature of the temperature sensor 16 is higher than that of the temperature sensor 12.

Upon receipt of a logic "1" signal coming from the comparator 513, the timer circuit 514 delivers a recovery instruction signal R over a predetermined time period $t_2$, for example one minute, following a predetermined time period $t_1$, for example five minutes, from the reception of that logic signal.

The recovery instruction signal R is sent to the valve drive control circuit 603 in the branch unit B.

The operation of the air-conditioner will be explained below.

Suppose, for example, that a cooling, a cooling and a heating operation mode are requested from the indoor units $C_1$, $C_2$ and $C_3$, respectively, and that a total of requested cooling power levels is greater than that of requested heating power levels.

Figure 5:
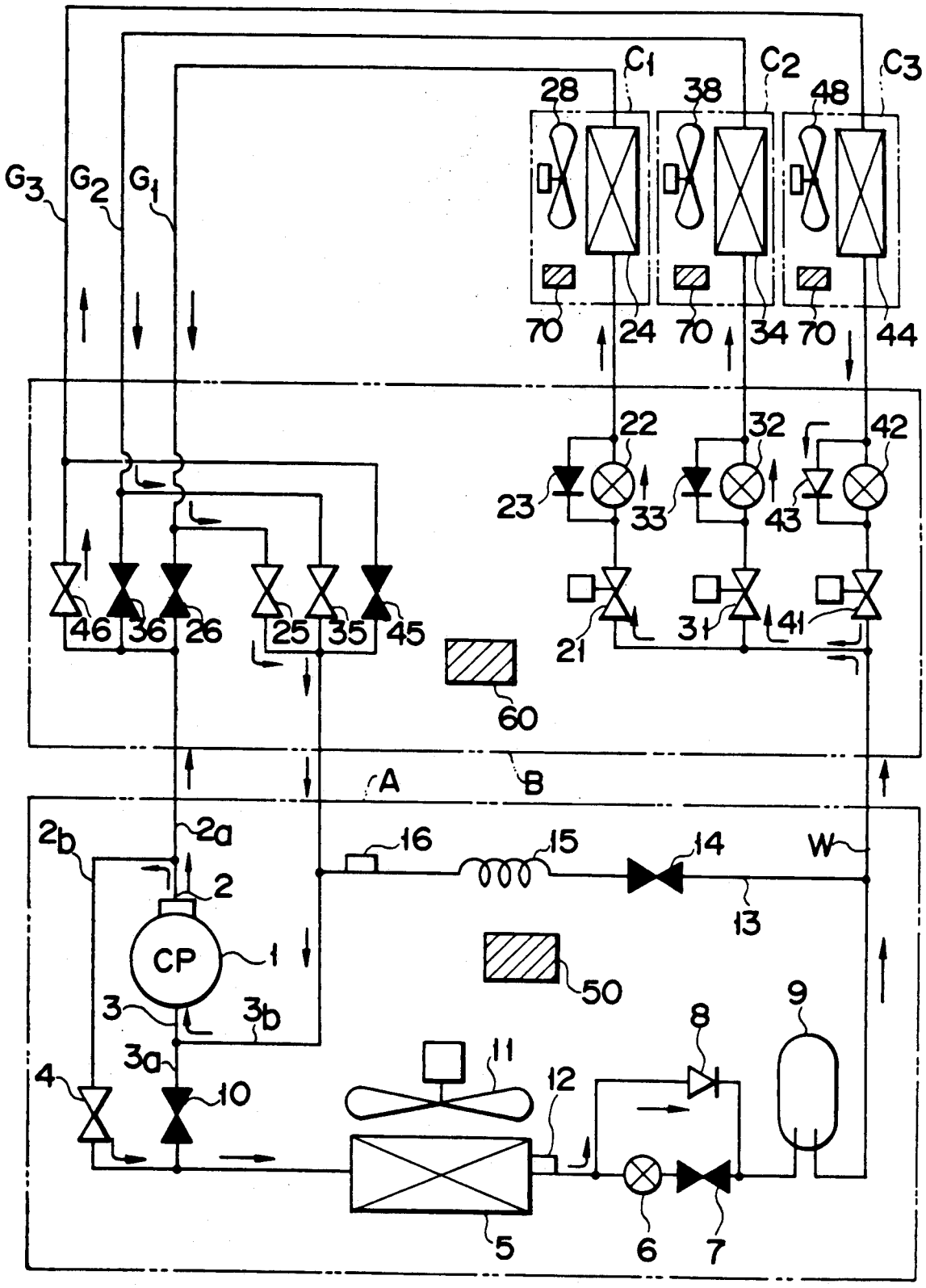
FIG. 5 is a view showing a flow of a refrigerant in a cooling operation mode in the aforementioned embodiment.

In this case, the cooling operation mode is carried out and, as shown in FIG. 5, the two-way valve 4 in the outdoor unit A is opened as indicated by an unshaded symbol and the two-way valves 7, 10 and 14 are closed as indicated by a shaded symbol.

Thus the outdoor heat exchanger 5 is connected to the delivery tube **2*b* of the compressor 1**.

In the branch unit B, the two-way valves 25, 35 and 46 are opened as indicated by an unshaded symbol and the two-way valves 26, 36 and 45 are closed as indicated by a shaded symbol.

Thus the gas-side tubes $G_1$ and $G_2$ corresponding to the indoor units $C_1$ and $C_2$ calling for the cooling operation mode are connected to the suction tube **3*b* of the compressor 1, and the gas-sided tube $G_3$ corresponding to the indoor units $C_3$ calling for the heating operation mode is connected to the delivery tube 2*a* of the compressor 1**.

A refrigerant which is delivered from the compressor 1 is sent via the two-way valve 4 to the outdoor heat exchanger 5 where it is condensed. The refrigerant, after passing through the heat exchanger 5, flows into the indoor units $C_1$ and $C_2$ via the check valve 8 and liquid tank 9 and then, respectively, via the PMV's 21 and 31 and expansion valves 22 and 32. The refrigerant is evaporated in the indoor units $C_1$ and $C_2$ and the refrigerant streams of the indoor units $C_1$ and $C_2$ and sucked into the compressor 1, respectively, via the two-way valves 25 and 35.

A refrigerant stream delivered from the compressor 1 is flowed via the two-way valve 46 into the outdoor unit $C_3$ where it is condensed. The refrigerant coming from the indoor unit $C_3$ via the check valve 43 and PMV 41 meets the refrigerant stream which flows toward the indoor units $C_1$ and $C_2$ (PMV's 21 and 31).

Thus the outdoor heat exchanger 5 serves as a condenser, the indoor heat exchanger 24 and 34 as an evaporator, and the indoor heat exchanger 44 as a condenser.

In this case, a portion of absorption heat of the indoor units $C_1$ and $C_2$ is utilized as a heat liberation for the indoor unit $C_3$.

The output frequency of the inverter circuit 50 is set in accordance with a total cooling power level requested. Thus the compressor 1 performs a function adequate enough to cover the cooling power levels of the indoor units $C_1$ and $C_2$ of greater load.

At this time, the extent of opening of the PMV's 21 and 31 is controlled in accordance with the cooling power levels requested from the indoor units $C_1$ and $C_2$, enabling refrigerant streams to properly flow into the indoor units $C_1$ and $C_2$.

The extent of opening of the PMV 41 is controlled, for the indoor unit $C_3$, in accordance with a heating power level requested from the indoor units $C_3$, ensuring a proper flow of a refrigerant stream into the indoor unit $C_3$.

Let it then be assumed that a heating, a heating and a cooling operation mode are requested from the indoor units $C_1$, $C_2$ and $C_3$, respectively, and that a total heating power level requested is greater than a total cooling power level requested.

Figure 6:
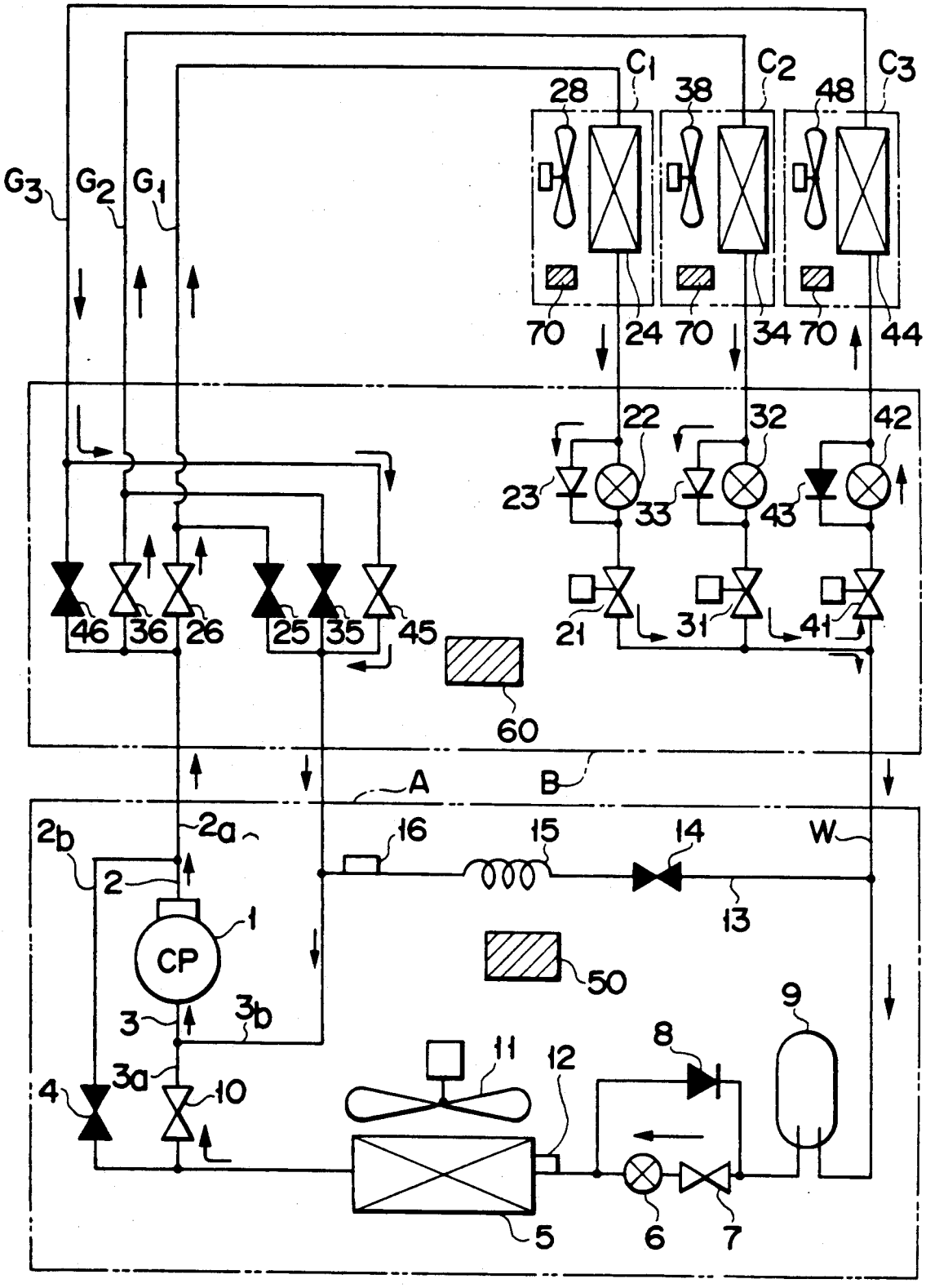
FIG. 6 is a view showing a flow of a refrigerant in a heating operation mode in the aforementioned embodiment.

In this case, the heating operation mode is determined and, as shown in FIG. 6, the two-way valves 4 and 14 in the outdoor unit A are closed as indicated by a shaded symbol and the two-way valves 7 and 10 in the outdoor unit A are opened as indicated by an unshaded symbol.

Thus the outdoor heat exchanger 5 is connected to the suction tube **3*a* of the compressor 1**.

In the branch unit B, the two-way valves 45, 26 and 36 are opened as indicated by an unshaded symbol and the two-way valves 25, 35 and 46 are closed as indicated by a shaded symbol.

Thus the gas-side tubes $G_1$ and $G_2$ of the indoor units $C_1$ and $C_2$ calling for the heating operation mode are connected to the delivery tube **2*a* of the compressor 1. The gas-side tube $G_3$ of the indoor units $C_3$ calling for the cooling operation mode is connected to the suction tube 3*b* of the compressor 1**.

The refrigerant delivered form the compressor 1 flows through the two-way valves 26 and 36 into the indoor units $C_1$ and $C_2$ where it is condensed. The refrigerant streams coming from the indoor units $C_1$ and $C_2$ are flowed respectively via the check valves 23 and 33 and PMV's 21 and 31 and then via the liquid tank 9, two-way valve 7 and expansion valve 6 into the outdoor heat exchanger 5. In the outdoor heat exchange 5, the refrigerant is evaporated. The evaporated refrigerant is sucked via the two-way valve 10 into the compressor 1.

The refrigerant streams which pass through the indoor units $C_1$ and $C_2$, check valves 23 and 33, and PMV's 21 and 31 enter the indoor units $C_3$ past the PMV 41 and expansion valve 42. In the indoor unit $C_3$, the refrigerant stream is evaporated and sucked into the compressor 1 via the two-way valve 45.

Thus the indoor heat exchangers 24 and 34 function as a condenser, the outdoor heat exchanger 5 as an evaporator, and the indoor heat exchanger 44 as an evaporator.

In this way, absorption heat in the outdoor heat exchanger 5 and indoor heat exchanger 44 is utilized as a heat liberation in the indoor units $C_1$ and $C_2$.

The output frequency of the inverter circuit 502 is set in accordance with a total heating power level requested. Thus the compressor 1 performs a function adequate enough to cover the heating power level in the indoor units $C_1$ and $C_2$ of greater load.

At this time, the extent of opening of the PMV's 21 and 31 is opened in accordance with the heating power level requested from the indoor units $C_1$ and $C_2$, allowing a proper flow into the indoor units $C_1$ and $C_2$.

In the indoor unit $C_3$, the extent of opening of the PMV 41 is controlled in accordance with a cooling power level requested from the indoor unit $C_3$, ensuring a proper the refrigerant stream into the indoor units $C_3$.

Let it again be supposed that a cooling operation, a stop and a heating operation mode are requested from the indoor units $C_1$, $C_2$ and $C_3$, respectively, and that a difference between a total cooling power level requested and a total heating power level requested falls within a predetermined range, that is, a total cooling power level is substantially equal to a total heating power level.

Figure 7:
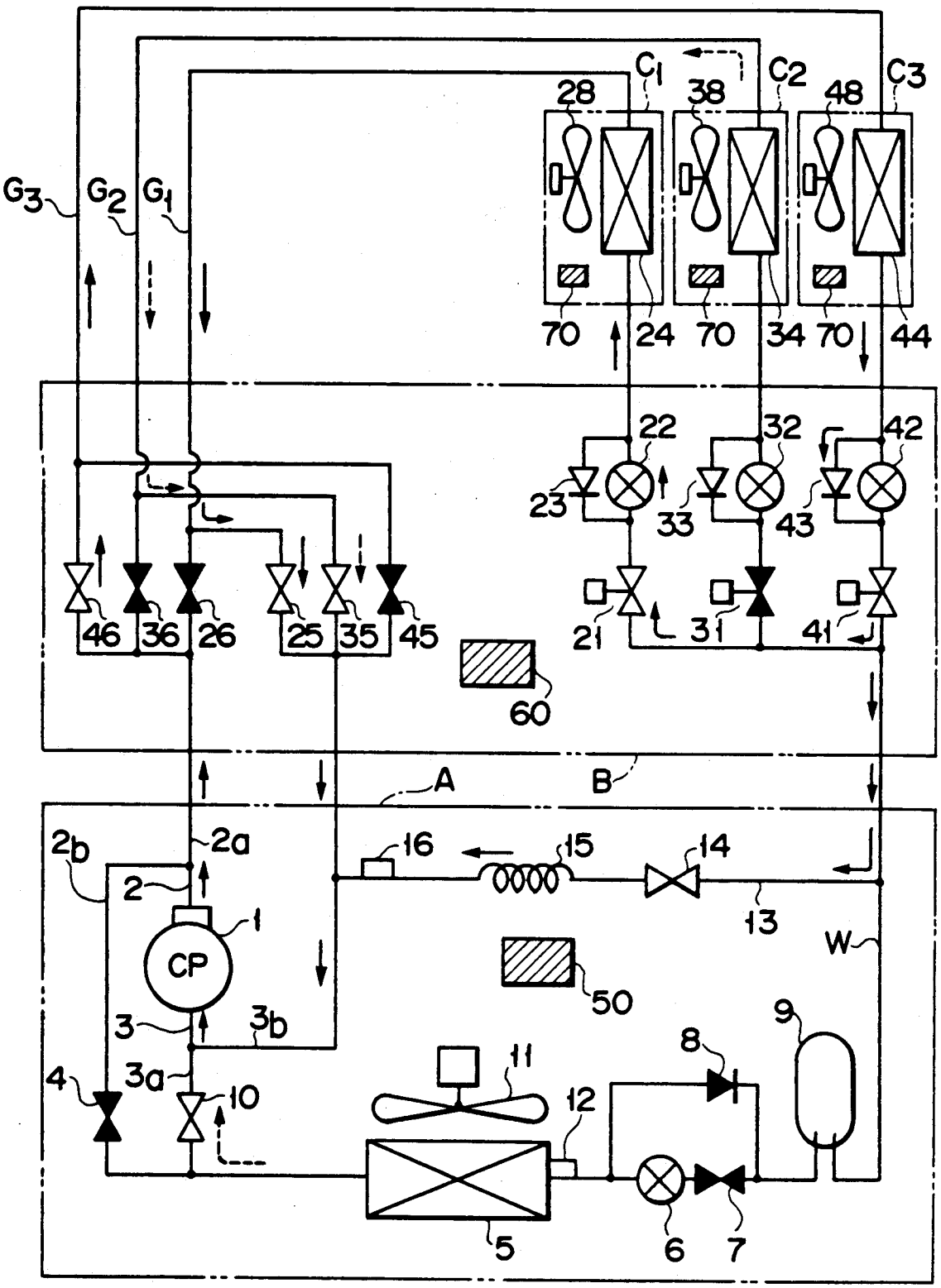
FIG. 7 is a view showing a flow of a refrigerant in a stop mode of an outdoor heat exchanger of the aforementioned embodiment.

In this case, the stop mode of the outdoor heat exchanger 5 is determined. As shown in FIG. 7, the two-way valves 4 and 7 are closed as indicated by a shaded symbol and the two-way valves 10 and 14 are opened as indicated by an unshaded symbol.

In the branch unit B, the two-way valves 25, 35 and 46 are opened as indicated by an unshaded symbol and the two-way valves 26, 36 and 45 are closed by a shaded symbol. The PMV 31 corresponding to the indoor units $C_2$ in the stop mode is fully closed as indicated by a shaded symbol.

A refrigerant coming from the compressor 1 enters the indoor unit $C_3$ on the "heating" side through the two-way valve 46. The refrigerant is condensed in the indoor unit $C_3$.

The refrigerant coming from the indoor unit $C_3$ flows via the check valves 43 and PMV 41 and then via the PWV 21 and expansion valve 22 into the indoor unit $C_1$ where it is evaporated.

A refrigerant coming from the indoor unit $C_1$ is moved past the two-way valve 25 and sucked into the compressor 1.

Thus absorption heat as produced in the indoor unit $C_1$ is utilized as liberation heat in the indoor unit $C_3$.

The output frequency of the inverter circuit 502 is set in accordance with a heating power level requested from the indoor unit $C_3$.

The extent of opening of the PMV 41 is controlled in accordance with a heating power level requested from the indoor unit $C_3$ so that a proper amount of refrigerant flows into the indoor unit $C_3$.

The extent of opening of the PMV 21 is controlled in accordance with a refrigerant power level requested form the indoor unit $C_1$, ensuring a proper flow of refrigerant into the indoor unit $C_1$.

In the stop mode of the outdoor heat exchanger 5, a liquid form of refrigerant in the indoor unit C3 is accumulated into the liquid tank 9 on the side of the outdoor unit A, while at the same time it is sucked into the compressor 1 via the bypass tube 13. At this time, a temperature prevailing in the refrigerant flowing in the bypass tube 13 is detected by the temperature sensor 16 in which case the detected temperature corresponds to a refrigerant's saturation temperature.

Since, in the stop mode of the outdoor heat exchanger 5, the two-way valves 7 and 10 are closed and opened, respectively, a refrigerant accumulated in the outdoor heat exchanger 5 is sucked into the compressor 1. At the same time, the PMV 31 is fully closed and the two-way valve 35 is opened, allowing the refrigerant which is accumulated in the indoor unit $C_2$ in the stop mode to be sucked into the compressor 1.

Thus the recovery of the refrigerant is carried out.

If outdoor air is low with the outdoor heat exchanger 5 in the stop mode, then a temperature in the heat exchanger 5 is low compared with the temperature of the indoor heat exchanger 24. In this case, a suction pressure is created toward the outdoor heat exchanger 5, causing some refrigerant stream which tries too be sucked into the compressor 1 to leak toward the outdoor heat exchanger 5 side via the two-way valve 10.

Thus the leaking refrigerant w 11 eventually be accumulated in the outdoor heat exchanger 5.

At this time, the detection temperature (saturation temperature) of the temperature sensor 16 is high compared with the detection temperature of the temperature sensor (the temperature of the outdoor heat exchanger 5) 12.

Figure 8:
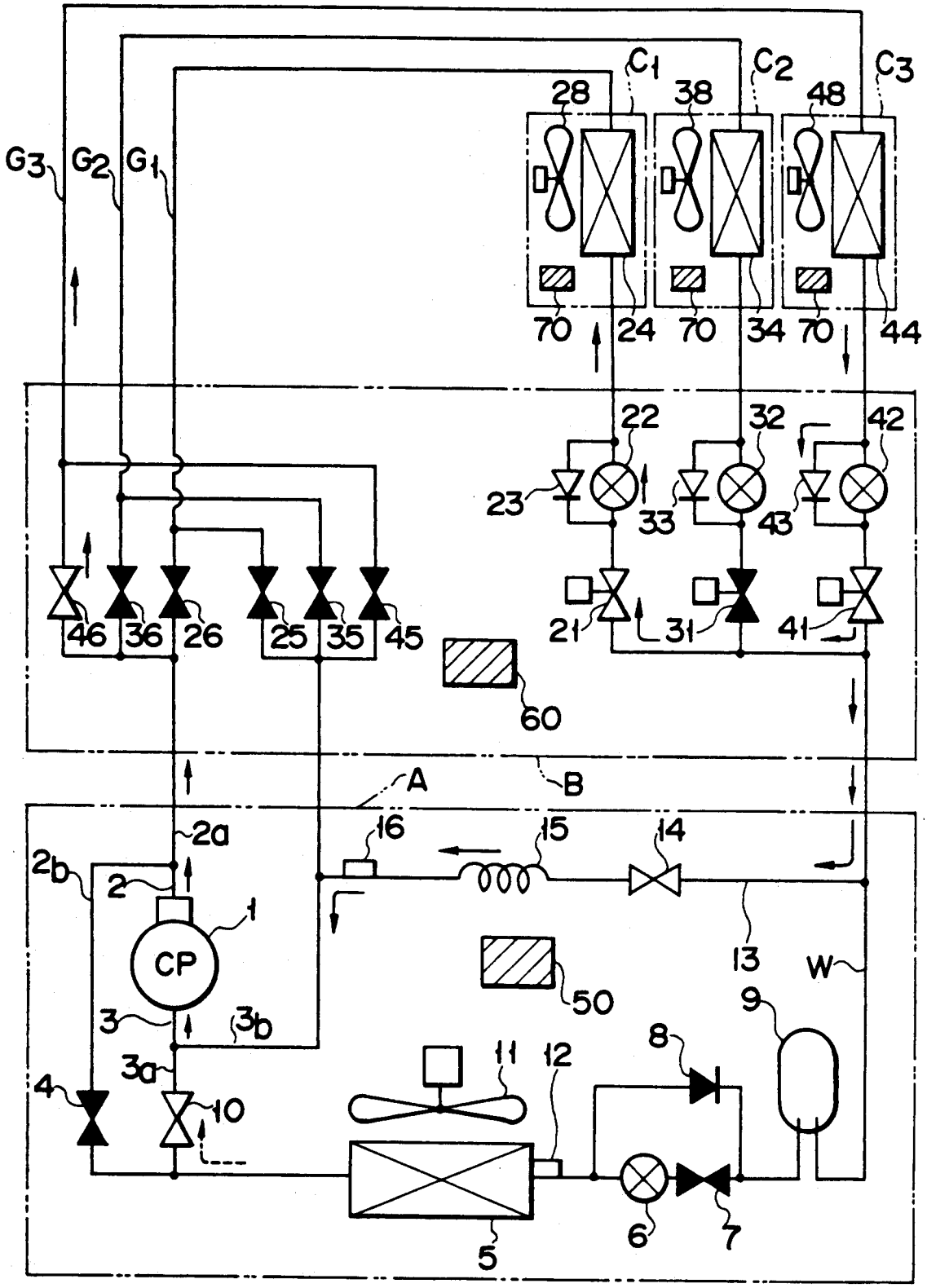
FIG. 8 is a view showing a flow of a refrigerant upon the recovery of a refrigerant in the aforementioned embodiment.

If this adverse situation occurs, then the two-way valves 25 and 35 are closed over a predetermined time period $t_2$, for example one minute, following a predetermined time period $t_1$, for example five minutes, from this occurrence. This state is shown in FIG. 8.

When the two-way valves 25 and 35 are closed, a temperature in the refrigerant sucked into the compressor 1 is low compared with a temperature prevailing in the outdoor heat exchanger 5, causing a refrigerant which is accumulated in the outdoor heat exchanger 5 to be forcedly sucked into the compressor 1.

Thus no short supply of refrigerant into the indoor units $C_3$ and $C_1$ occurs, ensuring adequate cooling and heating power levels.

A second embodiment of the present invention will now be explained below. In the second embodiment, the same reference numerals are employed to designate parts or elements corresponding to those shown in the first embodiment and further explanation is, therefore, omitted. Compared with the first embodiment, a temperature sensor 12, bypass tube 13, two-way valve 14, capillary tube 15 and temperature sensor 16 are eliminated as will be appreciated from FIG. 9.

A temperature sensor 27 is mounted on a tube between an expansion tube 22 and an indoor unit $C_1$, a temperature sensor 37, between an expansion valve 32 and an indoor unit $C_2$, and a temperature sensor 47 between an expansion valve 42 and an indoor unit $C_3$.

Figure 9:
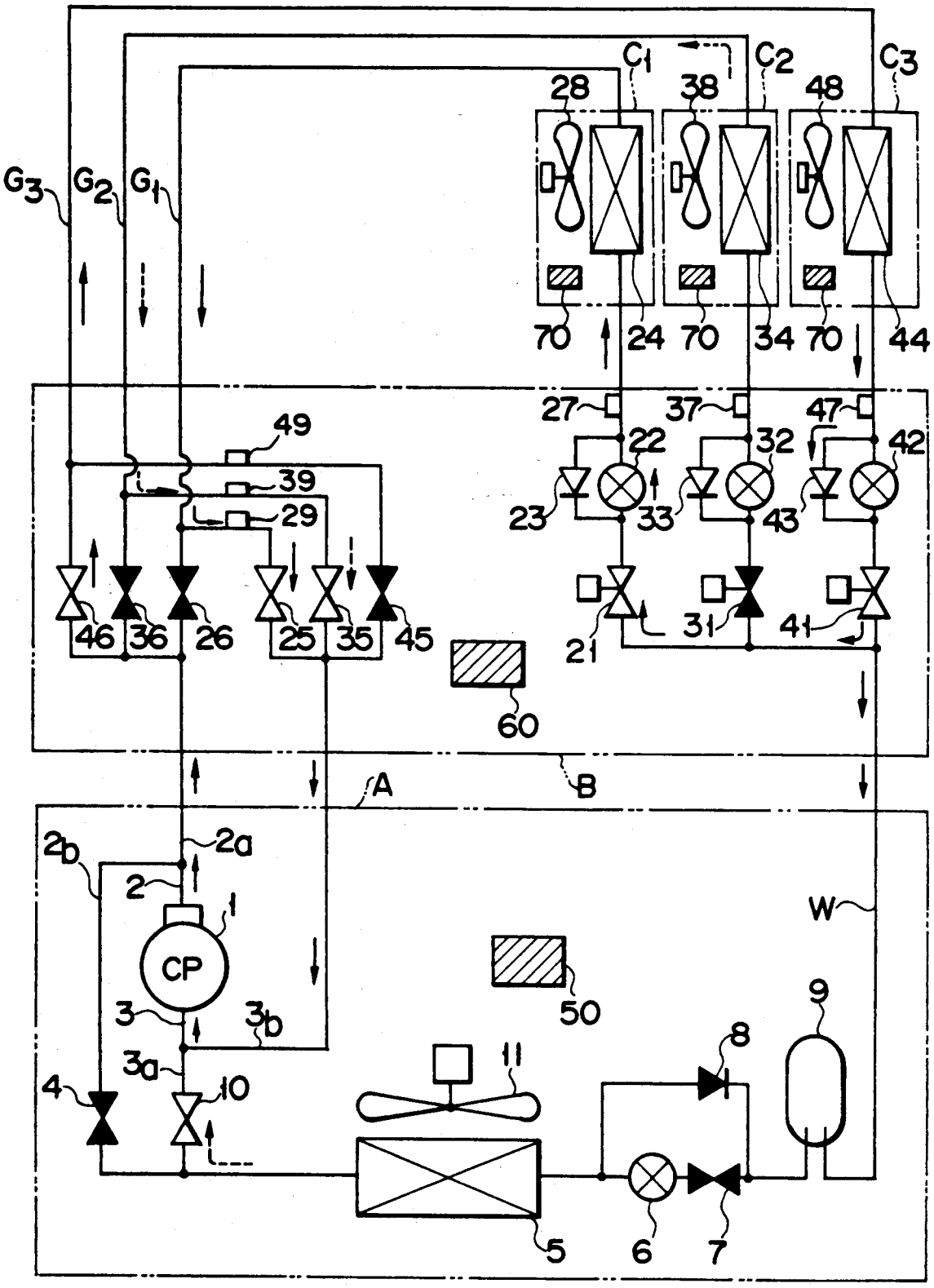
FIG. 9 is a view showing an arrangement of a refrigerating apparatus and a flow of a refrigerant in a stop mode of an outdoor heat exchanger, in a second embodiment of the present invention.

In one route of each of gas-side tubes $G_1$, $G_2$ and $G_3$, a corresponding one of temperature sensor 29, 39 and 49 is provided as will be seen from FIG. 9.

The temperature sensor 29, 39 and 49 are so provided as to detect temperature in the corresponding tube.

Figure 10:
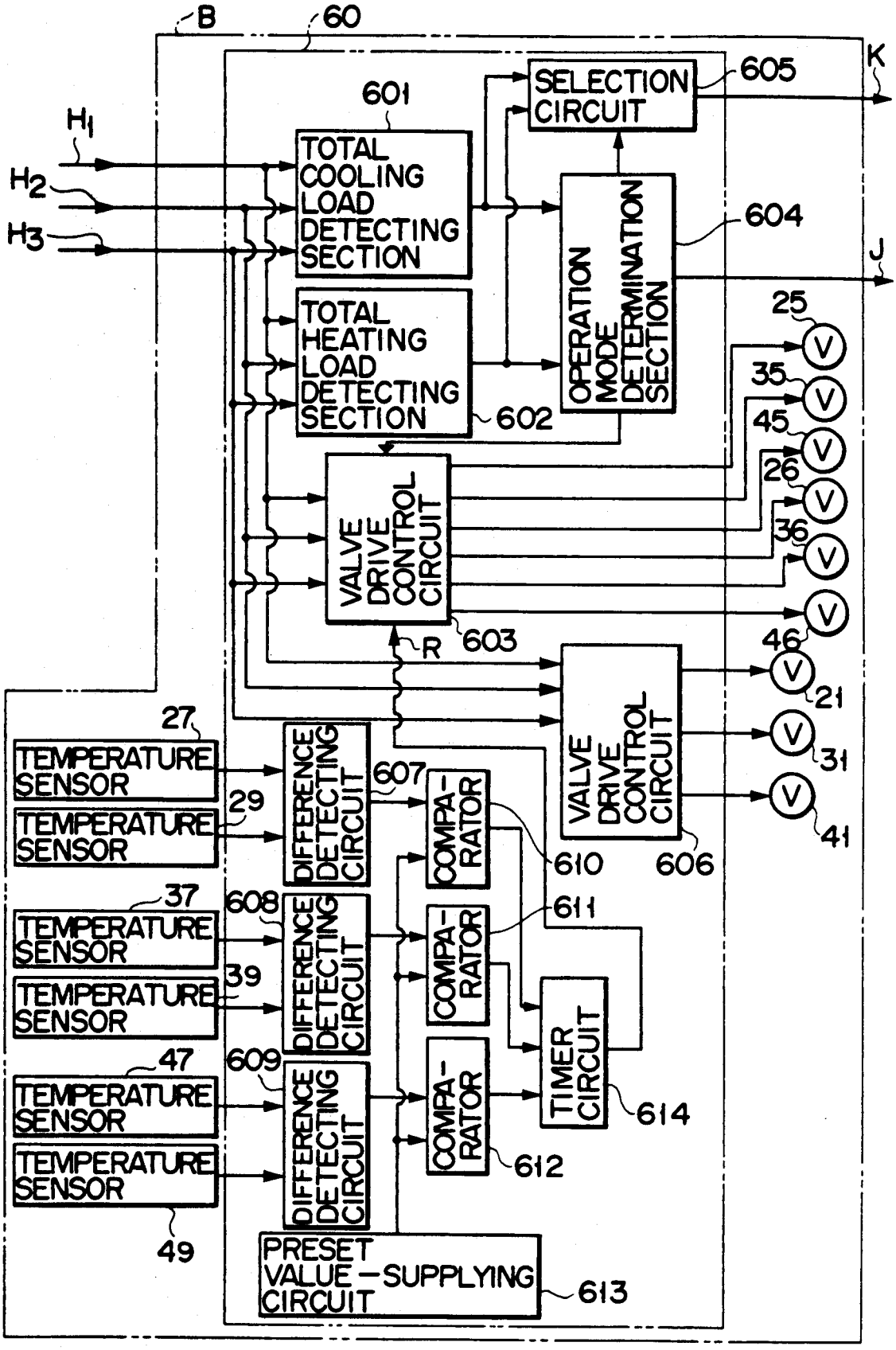
FIG. 10 is a block diagram showing a multi-control section and its peripheral circuits in the aforementioned embodiments.
Figure 11:
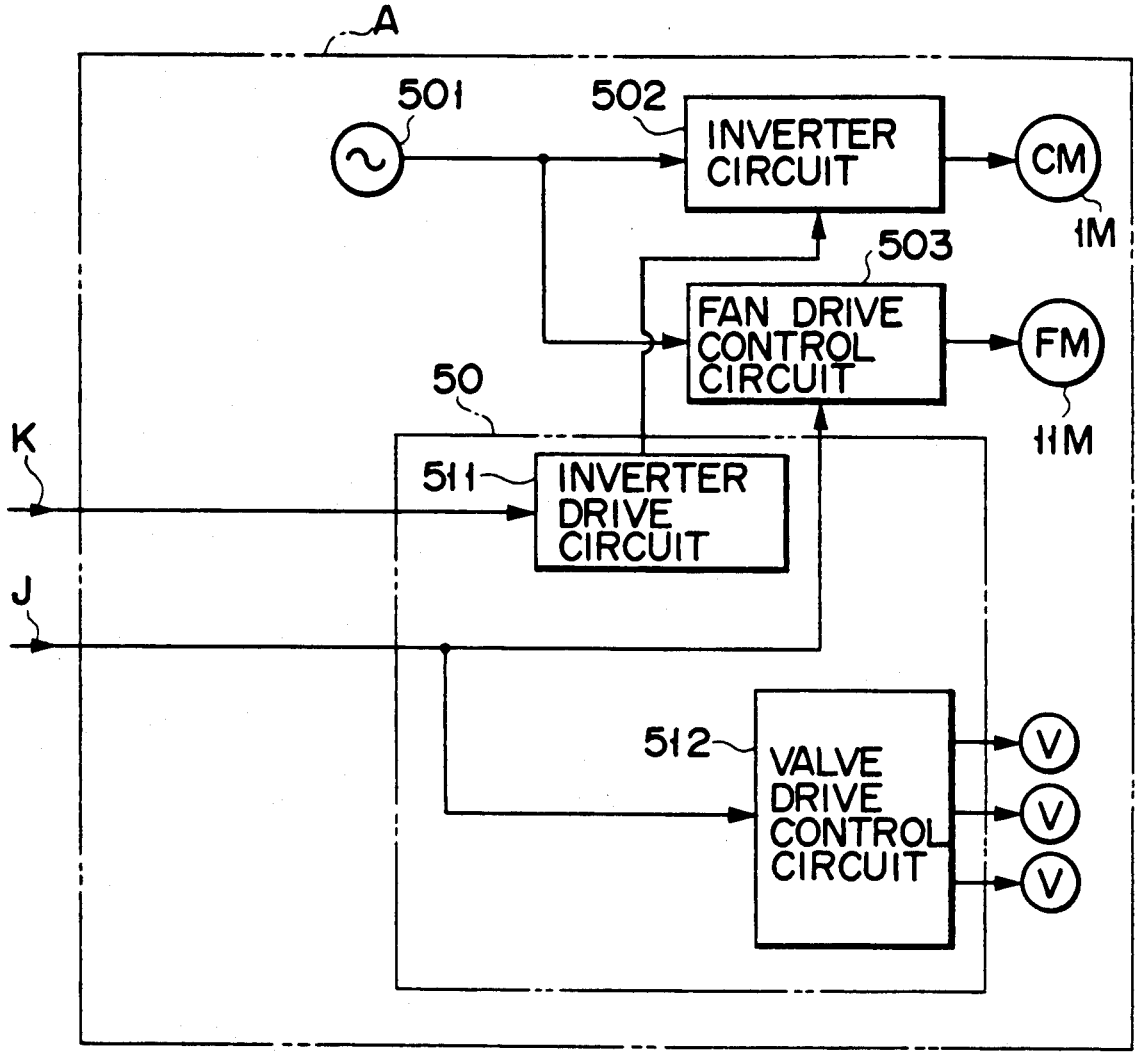
FIG. 11 is a block diagram showing an outdoor control section and its peripheral circuits in the aforementioned embodiment.

As shown in FIG. 10, a multi-control section 60 comprises a total cooling load detecting section 601, total heating load detecting section 602, valve drive control circuit 603, operation mode determination section 604, selection circuit 605, valve drive control circuit 606, difference detecting circuits 607, 608 and 609, comparators 610, 611 and 612, preset value-supplying circuit 613 and timer circuit 614.

The valve drive control circuit 603 performs operations as set out below.

(1) A cooling and a heating operation mode requested are determined by signals $H_1$, $H_2$ and $H_3$ of the respective indoor control section 70.

(2) The opening and closing of the two-way valves 25, 35, 45, 26, 36, and 46 are controlled in accordance with a corresponding result of determination. For example, the two-way valves 25 and 26 are opened and closed, respectively, when a cooling operation mode is requested by a signal $H_1$ and the two-way valves 25 and 26 are closed and opened, respectively, when a heating operation mode is requested by a signal $H_1$.

(3) When a stop mode of the outdoor heat exchanger 5 is stopped by the operation mode determination section 604, the two-way valves 25, 35 and 45 are forcedly closed upon receipt of a recovery instruction signal R from the timer circuit 614.

The difference detecting circuit 607 detects a difference between the detection temperature of the temperature sensor 27 and that of the temperature sensor 29. The temperature difference corresponds to the superheated level of a refrigerant in the indoor heat exchanger 24, when the indoor heat exchanger 24 acts as an evaporator.

The difference detection circuit 608 detects a difference between the detection temperature of the temperature sensor 37 and that of the temperature sensor 39. The temperature difference corresponds to a superheated level of a refrigerant in the indoor heat exchanger 34, when the indoor heat exchanger 34 acts as an evaporator.

The difference detection circuit 609 detects a difference between the detection temperature of the temperature sensor 47 and that of the temperature sensor 49. The temperature difference corresponds to a superheated level of refrigerant in the indoor heat exchanger 44, when the indoor heat exchanger 44 acts as an evaporator.

A comparator 610 compares a detection result of the difference detection circuit 607 and a preset value of the preset value-supplying circuit 613 and delivers a logic "1" signal when the detection result of the difference detecting circuit 607 is higher than the preset value of the preset value-supplying circuit 613.

A comparator 611 compares a detection result of the difference detection circuit 608 and the preset value of the preset value-supplying circuit 613 and delivers a logic "1" signal when the result of the difference detection circuit 608 is greater than the preset value of the preset value-supplying circuit 613.

A comparator 612 compares the detection result of the difference detection circuit 609 with the preset value of the preset value-supplying circuit 613 and delivers a logic "1" signal when the detection result of the difference detecting circuit 609 is greater than the preset value of the preset value-supplying circuit 613.

Upon receipt of a logic "1" signal coming from at least one of the comparators 610, 611 and 612, the timer circuit 614 delivers a recovery instruction signal R over a predetermined time period $t_2$, for example one minute, following a predetermined time period $t_1$, for example five minutes, from the reception of that logic "1" signal.

An outdoor control section 50 comprises an inverter drive circuit 511 and valve drive control circuit 512.

The following functions are performed by the outdoor control section 50, multi-control section 60, respective PMV's and respective two-way valves.

(1) A means is provided for determining a cooling operation mode when a total of a cooling power level or levels requested from one or more indoor units is greater than a total of a heating level or levels requested from one or more remaining indoor units.

(2) A means is provided for allowing a refrigerant which is delivered from the compressor 1 to pass through the indoor heat exchanger 5, when a cooling operation mode is determined, and to be returned back to the compressor 1 through one or more indoor units calling for the cooling operation mode.

(3) A means is provided for allowing one stream of a refrigerant which is delivered from the compressor 1 to pass through one or more indoor units calling for a heating operation mode, when a cooling operation mode is determined, and to meet a refrigerant stream into one or more indoor units calling for a cooling operation mode.

(4) A means is provided for determining a heating operation mode when a total of a heating power level or levels requested from one or more indoor units is greater than a total of a cooling power levels or levels requested from one or more indoor units.

(5) A means is provided for allowing a refrigerant which is delivered from the compressor 1 to pass through one or more indoor units calling for a heating operation mode and to be returned back to the compressor 1 via the indoor heat exchanger 5.

(6) A means is provided for allowing one stream of a refrigerant which is circulated through one or more indoor units calling for a heating operation mode to pass through one or more indoor units calling for a cooling operation mode and to be returned back to the compressor 1.

(7) A means is provided for determining a stop mode of the outdoor heat exchanger 5 when a difference between a total of a heating power level or levels requested from one or more indoor units and a total of a cooling power level or levels requested from one or more remaining indoor units falls within a predetermined range.

(8) A means is provided for allowing a refrigerant which is delivered from the compressor 1 to pass through one or more indoor units calling for a heating operation mode, when a stop mode of the outdoor heat exchanger 5 is determined, and to be returned back to the compressor 1 through one or more indoor units calling for a cooling operation mode.

(9) A means is provided for detecting a super-heated level of a refrigerant in one or more indoor units calling for a cooling operation mode, when a stop mode of the indoor heat exchanger 5 is determined.

(10) A means is provided which, when a stop mode of the outdoor heat exchanger 5 is determined, recovers a refrigerant accumulated in the outdoor heat exchanger 5 back into the compressor 1 if a result (a superheated level) of the aforementioned detecting means is higher than a preset value.

The aforementioned detecting means detects, as an superheated level of a refrigerant, a difference between the temperature of a refrigerant flowing into one or more indoor units calling for a cooling operation mode and that of a refrigerant flowing out of the indoor unit and comprises temperature sensors 27, 37, 47, 28, 38 and 48 and difference detecting circuits 607, 608 and 609.

The operation of the air conditioner as set out above will be explained below.

The functions of the cooling and heating operation modes are the same as these as set out in connection with the first embodiments.

Now let it be supposed that, with the outdoor heat exchanger 5 set in the stop mode, a difference between the total cooling power level and the total heating level falls within a given range, that is, both the total heating and cooling power levels are substantially the same as each other.

In this case, the stop mode of the outdoor heat exchanger 5 is determined, causing the two-way valves 4 and 7 to be closed as indicated by shaded symbol and the two-way valves 10 and 14 to be opened as indicated by an unshaded symbol in FIG. 9.

In the branch unit B, the two-way valves 25, 35 and 46 are opened as indicated by an unshaded symbol and the two-way valves 26, 36 and 45 are closed as indicated by a shaded symbol in FIG. 9. Further, a PMV 31 corresponding to the indoor unit $C_2$ in the stop mode is fully closed as indicated by a shade symbol in FIG. 9.

A refrigerant which is delivered from the compressor 1 flows through the two-way valve 46 into the indoor units $C_3$ calling for the heating operation mode where it is condensed.

The refrigerant which passes through the indoor unit $C_3$ flows past the check valve 43 and PMV 41 and then past the PMV 21 and expansion valve 22 into the indoor unit $C_1$ where it is evaporated.

The refrigerant which passes through the indoor unit $C_1$ flows past the two-way valve 25 and is sucked into the compressor 1, that is, the absorption heat of the indoor unit $C_1$ is utilized as liberation heat for the indoor unit $C_3$.

The output frequency of the inverter circuit 502 is set in accordance with a heating power level requested from the indoor units $C_3$.

The extent of opening of the PMV 41 is controlled in accordance with a heating power level requested from the indoor unit $C_3$, allowing a proper amount of refrigerant to flow into the indoor unit $C_3$.

In the indoor unit $C_1$, the extent of opening of the PMV 21 is controlled in accordance with a cooling power level requested from the indoor unit $C_1$, allowing a proper amount of refrigerant to flow into the indoor unit $C_1$.

In the stop mode of the outdoor heat exchanger 5, one stream of a refrigerant which is liquefied at the indoor unit $C_3$ is directed toward the outdoor unit A side and accumulated in the liquid tank 9.

In the stop mode of the outdoor heat exchanger 5, the two-way valve 7 is closed and the two-way valve 10 is opened, allowing a refrigerant which is accumulated at the outdoor heat exchanger 5 to be sucked into the compressor 1. As the same time, the PMV 31 is fully closed and the two-way valve 35 is opened, allowing a refrigerant which is accumulated in the indoor unit $C_2$ of the stop mode to be sucked into the compressor 1, that is, allowing a recovery of the refrigerant.

In the stop mode of the outdoor heat exchanger 5, when the outdoor temperature is low, a temperature in the heat exchanger 5 is low compared with the temperature of the indoor heat exchanger 24. In the case, a suction pressure is developed toward the outdoor heat exchanger 5 side, allowing one stream of a refrigerant which tends to be sucked into the compressor 1 to leak toward the outdoor heat exchanger 5 side via the two-way valve 10.

Eventually, the refrigerant is accumulated in the outdoor heat exchanger 5.

Since, at this time, a lesser amount of refrigerant is circulated through the indoor units $C_3$ and $C_1$, a high superheated form of refrigerant is prevalent in the indoor heat exchanger 24 acting as an evaporator.

The extent of superheating the refrigerant in the indoor heat exchanger 24 is detected as a difference between a result of detection by the temperature sensor 27 and that by the temperature sensor 29.

Figure 12:
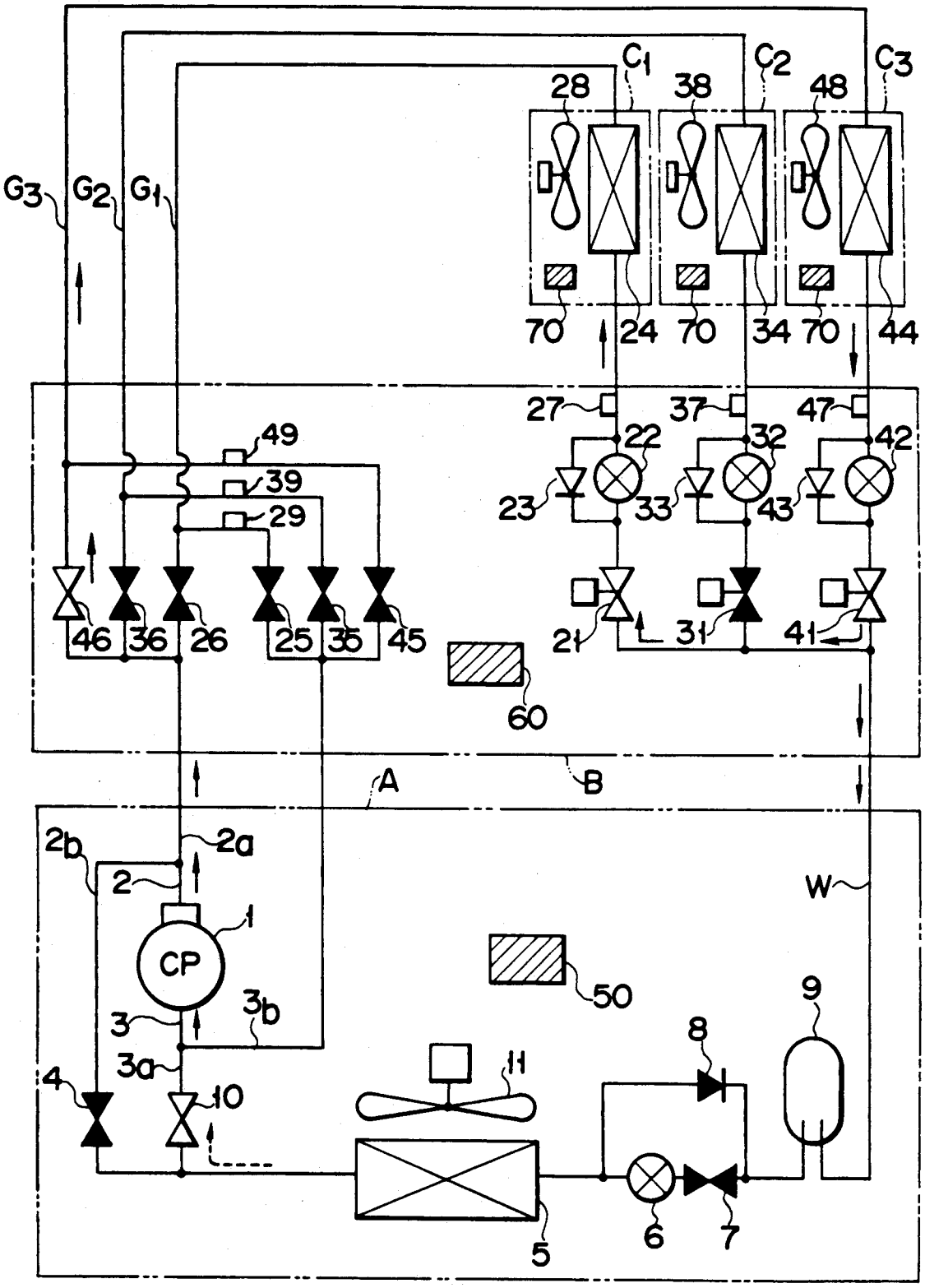
FIG. 12 is a view showing a flow of a refrigerant in the aforementioned embodiment when it is recovered.

When the superheated level there is higher than the preset value, the two-way valves 25 and 35 are closed over a predetermined time period $t_2$, for example one minute, following a predetermined time period $t_1$, for example five minutes, from that time. This state is shown in FIG. 12.

With the two-way valves 25 and 35 are closed, a temperature in a suction refrigerant relative to the compressor 1 is low compared with a temperature prevalent in the outdoor heat exchanger 5, allowing a refrigerant which is accumulated in the outdoor heat exchanger 5 to be forecedly sucked into the compressor 1.

Thus there is no short supply of a refrigerant through the indoor units $C_3$ and $C_1$, ensuring a cooling or a heating capacity adequate enough to cover them.

Although the present invention has been explained in conjunction with using three indoor units, it is not restricted thereto. Four or more indoor units may be employed according to the present invention.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A multi-system air conditioner comprising:

an outdoor unit including a compressor for sucking, compressing and delivering a refrigerant and an outdoor heat exchanger for making an exchange between heat in an incoming refrigerant and heat in outdoor air;

a plurality of indoor units including an indoor heat exchanger, each, for allowing an exchange between the heat in the incoming refrigerant and the heat in the indoor air and requesting at least one of a cooling operation mode and cooling power level and heating operation mode and heating power level;

means for determining a cooling operation mode when a total of a cooling power level or levels requested from one or more indoor units is greater than a total of a heating power level or levels requested from one or more remaining indoor units;

means for enabling a refrigerant which is delivered from the compressor to pass through the outdoor heat exchanger, when a cooling operation mode is determined, and to be returned back to the compressor via one or more indoor units calling for a cooling operation mode;

means for enabling one stream of the refrigerant which is delivered from the compressor to pass through one or more indoor units calling for a heating operation mode and to meet a refrigerant flowing into one or more outdoor units calling for a cooling operation mode;

means for determining a heating operation mode when a total of a heating power level or levels requested from one or more indoor units is greater then a cooling power level or levels requested from one or more remaining indoor units;

means for enabling the refrigerant which is delivered from the compressor to pass through one or more indoor units calling for a heating operation mode, when the heating operation mode is determined, and to be returned back to the compressor via the outdoor heat exchanger;

means for enabling one stream of a refrigerant which passes through one or more indoor units calling for a heating operation mode to circulate through one or more indoor units calling for a cooling operation mode, when a heating operation mode is determined, and to be returned back to the compressor;

first detecting means for detecting a temperature in the outdoor heat exchanger;

means for determining a stop mode of the outdoor heat exchanger when a difference between a total of a heating power level or levels requested from one or more indoor units and that of a cooling power level or levels requested from one or more remaining indoor units falls within a predetermined range;

means for enabling a refrigerant which is delivered from the compressor to pass through one or more indoor units calling for a heating operation mode, when the stop mode of the outdoor heat exchanger is determind, and to be returned back to the compressor via one or more indoor units calling for a cooling operation mode;

second detecting means for detecting a saturation temperature prevalent in the refrigerant flowing through the indoor unit, when the stop mode of the outdoor heat exchanger is determined; and recovering means which, when the stop mode of the outdoor heat exchanger is determined, enables a refrigerant which is accumulated on the outdoor heat exchanger to be recovered back to the compressor if a result of detection by the second detecting means is higher than a result of detection by the first detecting means.

2. The air conditioner according to claim 1, wherein said compressor has a suction inlet and delivery outlet for a refrigerant.

3. The air conditioner according to claim 1, wherein said first detecting means is composed of a temperature sensor.

4. The air conditioner according to claim 1, wherein said detecting means comprises a bypass tube, a two-way valve, a capillary tube and a temperature sensor.

5. The air conditioner according to claim 1, wherein, when said result of detection by said second detecting means is higher than said result of detection by said first detecting means, said recovering means recovers a refrigerant over a predetermined time period $t_2$ following a predetermined time period $t_1$ from that detection.

6. A multi-system air conditioner comprising:

an outdoor unit including a compressor for sucking, compressing and delivering a refrigerant and an outdoor heat exchanger for making an exchanger between heat in an incoming refrigerant and heat in outdoor air;

a plurality of indoor units including an indoor heat exchanger, each, for making an exchanger between heat in an incoming refrigerant and heat in indoor air and requesting either one of a cooling operation mode and cooling power level and a heating operation mode and heating power level;

means for determining a cooling operation mode when a total of a cooling power level or levels requested from one or more indoor units is greater than a total of a heating power level or levels requested from one or more remaining indoor units;

means for enabling a refrigerant which is delivered from the compressor to pass through the outdoor heat exchanger, when a cooling operation mode is determined, and to be returned back to the compressor via one or more indoor unit calling for a cooling operation mode;

means for enabling one stream of a refrigerant which is delivered out of the compressor to pass through one or more indoor units calling for a heating operation mode, when a cooling operation mode is determined, and to meet the stream of the refrigerant flowing into one or more indoor units calling for a cooling operation mode;

means for determining a heating operation mode when a total of a heating power level or levels requested from one or more indoor units is greater than a total of a cooling power level or levels requested from one or more remaining indoor units;

means for enabling a refrigerant which is delivered out of the compressor to pass through one or more indoor units calling for a heating operation mode, when a heating operation mode is determined, and to be returned back to the compressor via the outdoor heat exchanger;

means for enabling one stream of a refrigerant which passes through one or more indoor units calling for a heating operation mode to circulate through one or more indoor units calling for a cooling operation mode and to be returned back to the compressor;

means for determining a stop mode of the outdoor heat exchanger when a difference between the total of the heating power level or levels requested from one or more indoor units and the total of the cooling power level or levels requested from one or more remaining indoor units falls within a predetermined range;

means for enabling a refrigerant which is delivered out of the compressor to pass through one or more indoor units calling for a heating operation mode, when the stop mode of the outdoor heat exchanger is determined, and to be returned back to the compressor via one or more indoor unites calling for a cooling operation mode;

means for detecting a superheated level of a refrigerant in one or more indoor units calling for a cooling operation mode, when the stop mode of the outdoor heat exchanger is determined; and recovering means which, when the stop mode of the outdoor heat exchanger is determined, recovers a refrigerant which is accumulated in the outdoor heat exchanger back to the compressor if a result of detection by the detecting means is high compared with a preset value.

7. The air conditioner according to claim 6, wherein said compressor has a suction inlet and an delivery outlet for a refrigerant.

8. The air conditioner according to claim 6, wherein said detecting means detects, as a superheated level, a difference between a temperature in a refrigerant flowing into one or more indoor units calling for a cooling operation mode and a temperature in a refrigerant flowing out of the indoor unit.

9. The air conditioner according to claim 6, wherein, when a result of detection by the detecting means is high compared with a preset value, said recovering means recovers a refrigerant over a predetermined time period $t_2$ following a predetermined time period $t_1$ from that detection.

* * * * *